United States Patent [19]

Lawrence et al.

[11] 4,261,503

[45] Apr. 14, 1981

[54] BOX WITH RAISED AND CRUSHED END CLOSURE PANELS

[75] Inventors: Bryan Lawrence; Nigel E. Claxton, both of Cape Town, South Africa

[73] Assignee: Packaging Development Manufacturing (Proprietary) Limited, Cape Town, South Africa

[21] Appl. No.: 105,783

[22] Filed: Dec. 20, 1979

[51] Int. Cl.[3] ..... B65D 5/02

[52] U.S. Cl. ..... 229/37 R; 229/DIG. 11; 206/508; 206/511

[58] Field of Search ..... 229/37, 39, DIG. 11, 229/23 BT; 206/508, 509, 511; 220/380

[56] References Cited

U.S. PATENT DOCUMENTS

| | | | |
|---|---|---|---|
| 2,440,836 | 5/1948 | Turngren | 229/DIG. 11 |
| 2,917,223 | 12/1959 | Lebolt et al. | 229/DIG. 11 |
| 3,070,257 | 12/1962 | Botanowski | 206/508 |
| 3,101,278 | 9/1963 | Kuzna et al. | 206/511 X |
| 3,157,345 | 11/1964 | George | 229/23 BT |
| 3,197,109 | 7/1965 | Nelson | 229/37 R |
| 3,570,697 | 3/1971 | Langston | 206/509 |
| 3,790,019 | 2/1974 | Murray et al. | 229/DIG. 11 |
| 3,971,300 | 7/1976 | Bachner | 229/37 R X |

FOREIGN PATENT DOCUMENTS

| | | | |
|---|---|---|---|
| 1343060 | 10/1963 | France | 206/509 |

*Primary Examiner*—Davis T. Moorhead

[57] ABSTRACT

A box having side walls (10, 12, 14, 16), a first set of panels (20, 22, 24, 26) along the top edges of the side walls and a second set of panels (28, 30, 32, 34) along the bottom edges of the side walls. The first set of panels overlap one another to form a box top and the second set of panels similarly overlap to form a box base. The first set of panels are so shaped that the box top has some areas which are above the level of the remainder of the top. The panels forming the box base also provide areas which are above the level of the remainder of the base. Said areas of the top and base are of the same shape and layout so that when two boxes are stacked, said areas of the top are received in said areas of the base.

7 Claims, 7 Drawing Figures

BOX WITH RAISED AND CRUSHED END CLOSURE PANELS

This invention relates to boxes and to blanks from which the boxes are erected.

According to one aspect of the present invention there is provided a blank for erection into a box, the blank including four panels which form the side walls of the erected box and flaps joined to the four panels, the flaps, in the erected condition of the box, being folded inwardly so as to overlap one another to constitute the top and base of the box, the flaps being formed to define, in the erected condition of the box, formations on the base of the box which inter-engage with formations on the top of an identical box on which the box is stacked, thereby to inhibit relative lateral movement between the two boxes.

The flaps can have portions thereof cut away to provide said formations. Alternatively the flaps can be folded over on themselves to provide said formations. As a further alternative, the flaps can be compressed to provide said formations.

According to a further aspect of the present invention there is provided a box comprising four vertical panels which form the side walls thereof and flaps protruding inwardly from the upper and lower edges of said panels, the flaps overlapping one another to form the top and the base of said box, the flaps being formed so as to define formations on the underside of the base of the box which inter-engage with formations on the top face of the top of an identical box on which the box is stacked thereby to inhibit relative lateral movement between the two boxes.

According to yet another aspect of the invention there is provided a pair of blanks for erection into the telescopic inner and outer sleeves of a box, each blank comprising four panels which form the side walls of the sleeve and flaps joined to the four panels, the flaps, in the erected condition of the blanks, being folded inwardly so as to overlap one another to constitute a base or a top of the respective sleeve, the flaps of one of said blanks being formed to define, in the erected condition of the sleeve, formations which inter-engage with formations defined by the flaps of the other blank when it is erected thereby to inhibit relative lateral movement between two boxes when they are stacked.

According to a still further aspect of the present invention there is provided a box comprising inner and outer telescopic sleeves, each sleeve comprising four vertical panels which form the side walls thereof and flaps protruding inwardly from the panels, the flaps of the inner overlapping one another to form a base for the box and the flaps of the outer overlapping one another to form a top for the box, the flaps being formed so as to define formations on the underside of the base of the box which inter-engage with formations on the top face of the top of an identical box on which the box is stacked thereby to inhibit relative lateral movement between the two boxes.

By way of example only, preferred forms of the invention will now be described with reference to the accompanying drawings in which:

FIG. 1 is a plan view of one form of blank according to the invention;

FIGS. 2*a* and 2*b* are perspective views of the base and top parts of a box erected from the blank of FIG. 1;

Figure 1:
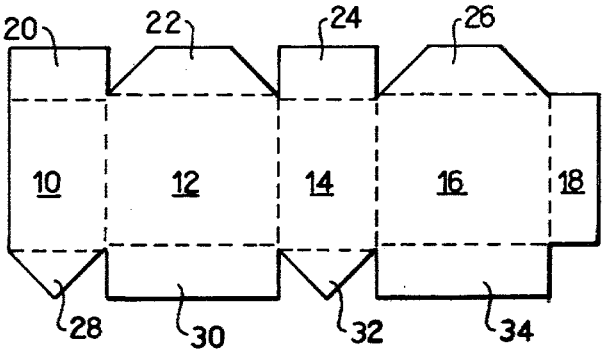

Referring to FIG. 1 of the drawings, there is illustrated a blank; which is preferably of cardboard or corrugated board, having four panels 10, 12, 14 and 16 which, in the erected condition of the blank, constitute the four side walls of a box.

An end flap 18 is provided adjacent the panel 16, the flap 18 being brought, during erection of the box, into overlapping relationship with the panel 10 at the opposite end of the blank before being stapled or otherwise secured to such panel. The flap 18 can be omitted and the panels 10 and 16 taped together to form the box.

Integral with each of the side wall-forming panels are flaps 20, 22, 24, 26, 28, 30, 32, 34 which project outwardly from such panels and which, in the erected condition of the box, are folded inwardly to form the bottom and top of the box.

Crease lines (shown as dashed lines in FIG. 1) are provided where the panels and flaps meet.

In the form of the invention shown in FIG. 1, the larger flaps 22, 26 joined to the panels 12 and 16 are cut at 45 degrees while the smaller flaps 28, 32 disposed along the opposite sides of the other two panels are also cut at 45 degrees.

Figure 2A:
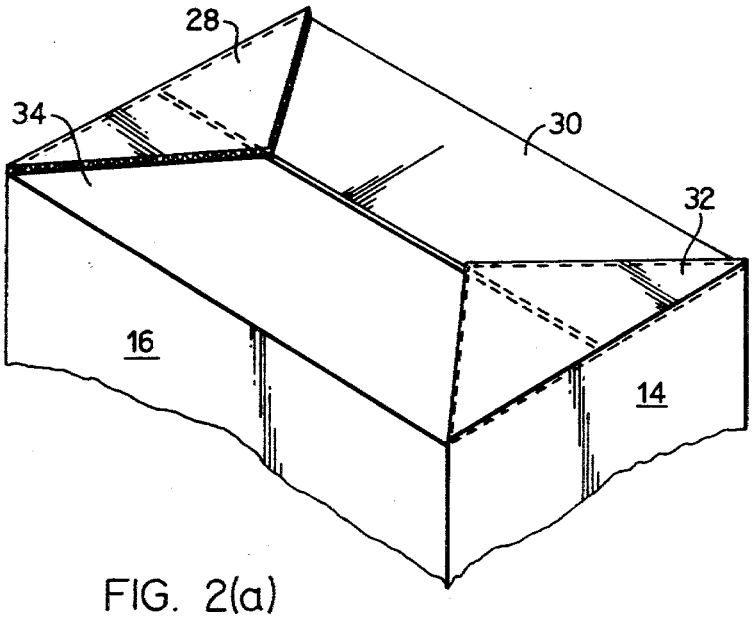
Figure 2B:
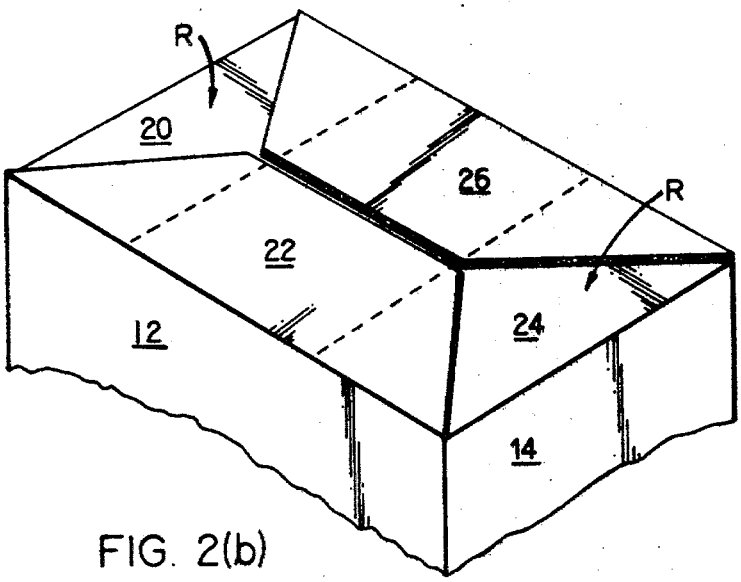

When a box is erected from the blank of FIG. 1, these cut-away sections provide recesses in which locate the raised formations on an adjacent box in a stack of such boxes. Thus, the recesses in the top of one box (which are of triangular form as shown at R in FIG. 2*b*) receive the raised formations on the base of the above box in the same stack (see FIG. 2*a*). These raised formations are constituted by the flaps 28 and 32. By virtue of such inter-engagement of formations of one box in complementary fashion with an adjacent box in the same stack, relative sliding movement between the boxes is restricted.

Figure 3:
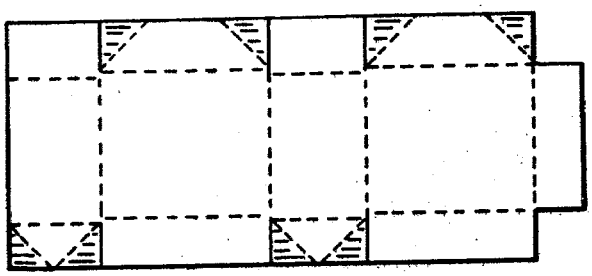
FIG. 3 is a plan view of a blank for erection into a box according to a second form of the invention.

In FIG. 3 of the accompanying drawings, another blank is shown. Instead of cutting away portions of the flaps, the flaps can be crushed, for instance, by a compression or other re-shaping operation to provide the recesses and raised formations as described above. The shaded areas are those which are compressed by crushing so that these areas of the flaps are thinner than the remaining areas.

Figure 4:
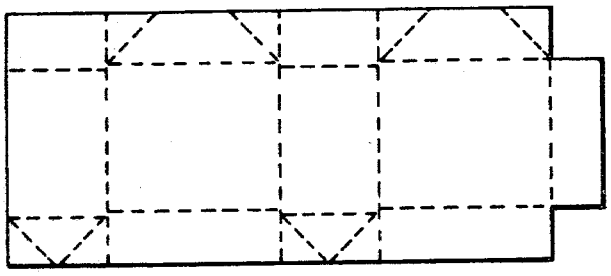
FIG. 4 is a plan view of a blank for erection into a box according to a third form of the invention.

In FIG. 4 of the drawings there is shown a third form of the invention in which the flaps are provided with crease lines to permit folding of the flaps to form the recess and raised formations.

Figure 5:
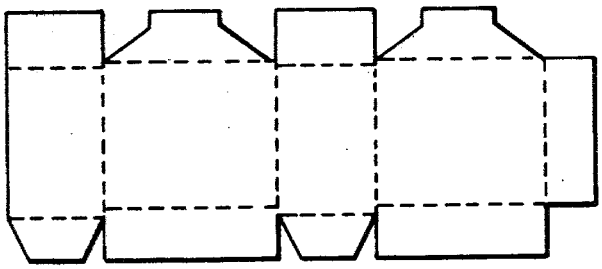
FIG. 5 is a plan view of a blank for erection into a box in accordance with a fourth form of the invention.
Figure 6:
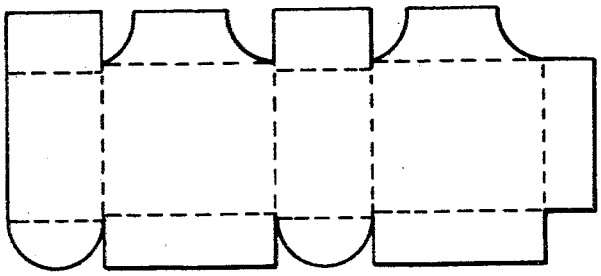
FIG. 6 is a plan view of a blank for erection into a box in accordance with a fifth form of the invention.

In FIGS. 5 and 6 of the drawings, differently shaped cut-away portions are shown.

It is envisaged that boxes according to the invention will be stacked on a pallet. By virtue of the recesses and raised formations described above, relative sliding movement between boxes in the stack is restricted. It is envisaged that outward leaning of a stack of boxes on a pallet will be prevented by the use of bands which engage formations on the boxes and which extend around the loaded pallet for securing the boxes in position to the pallet.

It will be understood that all the blanks described, when folded, give rise to boxes with vertical sides, tops and bases. However, it is possible for each box to be constituted by inner and outer telescopic sleeves. The telescopic sleeve forming the outer would comprise, referring to FIG. 1, the panels 10, 12, 14 and 16, the flap 18 and the flaps 20, 22, 24 and 26. The blank from which the inner is erected would comprise panels 10, 12, 14 and 16, the flap 18, and the flaps 28, 30, 32 and 34. The dimensions of the panels 10, 12, 14 and 16 of the blank forming the inner would be so dimensioned that the outer could slip easily over it. In this form FIG. 2*a* can be considered to be an underneath view of the telescopic inner and FIG. 2*b* can be considered to be the view of the telescopic outer.

The inner and outer need not be fully telescopic which would mean that the panels 10, 12, 14 and 16 of the outer would be smaller, in vertical height, than the panels 10, 12, 14 and 16 of the inner. Boxes comprising telescopic inners and outers can also be fabricated using the blanks of FIGS. 3 to 6.

We claim:

1. A blank for erection into a box, the blank including four panels which form the side walls of the erected box and first and second sets of flaps joined to said four panels, two flaps of the first set being non-rectangular in shape and the first set of flaps, in the erected condition of the box, being folded inwardly to constitute the top of the box with the two non-rectangular flaps overlapping the other two flaps of the first set to provide areas where the top is constituted by a single thickness of material and other areas where the top is of double thickness, two flaps of the second set also being non-rectangular in shape and the second set of flaps, in the erected condition of the box, being folded inwardly to constitute the base of the box with the two non-rectangular flaps of the second set overlapping the other two flaps of the second set to provide areas where the base is constituted by a single thickness of material and other areas where the base is of double thickness, the configuration of the flaps being such that the areas of the erected box top and base which are of double thickness are matched at the other end of the box by areas of the same shape and position and which are of single thickness, the non-rectangular flaps of the first set joining panels which form two opposed sides of the erected box and the non-rectangular flaps of the second set joining the panels which form the other two opposed sides of the erected box.

2. A blank for erection into a box, the blank including four panels which form the side walls of the erected box and first and second sets of flaps joined to said four panels, two flaps of the first set having areas which are of thinner material than the remainders thereof and the first set of flaps, in the erected condition of the box, being folded inwardly to constitute the top of the box with said two flaps overlapping the other two flaps of the first set to provide areas where the top is of double thickness and areas where the top is constituted by a single thickness plus a layer of said thinner material, two flaps of the second set also having areas which are of thinner material than the remainders thereof and the second set of flaps, in the erected condition of the box, being folded inwardly to constitute the base of the box with said two flaps of the second set overlapping the other two flaps of the second set to provide areas where the base is of double thickness and other areas where the base is constituted by a single thickness plus a layer of said thinner material, the configuration of the flaps being such that the areas of the top and base of the erected box which are of double thickness are matched at the other end of the box by areas of the same shape and position and which are of the single thickness plus the thinner material, said flaps of the first set which include areas of thinner material joining panels which forms two opposed sides of the erected box and said flaps of the second set which include thinner material joining the panels which form the other two opposed sides of the erected box.

3. A blank for erection into a box, the blank including four panels which form the side walls of the erected box and first and second sets of flaps joined to said four panels, two flaps of the first set of flaps having crease lines thereacross whereby portions of these two flaps can be folded to overlie other portions thereof and the first set of flaps, in the erected condition of the box, being folded inwardly to constitute the top of the box with said two flaps overlapping the other two flaps of the first set to provide areas where the top is constituted by three layers of material and areas where the top is of a lesser number of layers, two flaps of of the second set also having crease lines thereacross whereby portions of each of these two flaps can be folded to overlie other portions thereof and the second set of flaps, in the erected condition of the box, being folded inwardly to constitute the base of the box with said two flaps of the second set overlapping the other two flaps of the second set to provide areas where the base is constituted by three layers of material and other areas where the base is of a lesser number of layers, the configuration of the flaps being such that the areas of the erected box which are three layers thick are matched at the other end of the box by areas of the same shape and position and which are of a lesser number of thicknesses, the creased flaps of the first set joining panels which form two opposed sides of the erected box and the creased flaps of the second set joining the panels which forms the other two opposed sides of the erected box.

4. A box comprising four panels constituting the side walls of the box and first and second sets of flaps which join the upper and lower edges of the panels and which are folded inwardly to form the top and base of the box, two flaps of the first set being non-rectangular in shape and overlapping the other two flaps of the first set to provide areas where the top is constituted by a single thickness of material and other areas where the top is of double thickness, two flaps of the second set of flaps also being non-rectangular in shape and overlapping with the other two flaps of the second set to provide areas where the base is constituted by a single thickness of material and other areas where the base is of double thickness, the areas of the box top and base which are of double thickness being matched at the box base and top by areas of the same shape and position which are of single thickness, the non-retangular flaps of the first set joining panels which form two opposed sides of the box and the non-rectangular flaps of the second set joining the panels which form the other two opposed sides of the box.

5. A box comprising four panels constituting the side walls of the box and first and second sets of flaps which join the upper and lower edges of the panels and which are folded inwardly to form the top and base of the box, two flaps of the first set having areas which are of thinner material than the remainders thereof and overlapping the other two flaps of the first set to provide areas where the top is of double thickness and other areas where the top is constituted by a single thickness plus a layer of thinner material, two flaps of the second set of flaps also having areas which are of thinner material than the remainders thereof and overlapping with the two flaps of the second set to provide areas where the base is constituted by a double thickness and other areas where the base is constituted by a single thickness plus a layer of thinner material, the areas of the box and base which are of double thickness being matched at the box base and top by areas of the same shape and position which are of a single thickness plus a layer of thinner material, the first mentioned two flaps of the first set joining panels which form two opposed sides the box and the first mentioned two flaps of the second set joining the panels which form the other two opposed sides of the box.

6. A box comprising four panels constituting the side walls of the box and first and second sets of flaps which join the upper and lower edges of the panels and which are folded inwardly to form the top and base of the box, two flaps of the first set having crease lines thereacross whereby portions of each of these two flaps can be folded to overlie other portions thereof and overlapping the other two flaps of the first set to provide areas where the top is constituted by three thicknesses of material and other areas where the top is of a lesser number of thicknesses, two flaps of the second set of flaps also having crease lines thereacross whereby portions of each of these two flaps can be folded to overlie other portions thereof and overlapping with the other two flaps of the second set to provide areas where the base is constituted by three thicknesses of material and other areas where the base is of a lesser number of thicknesses, the areas of the box top and base which are of three thicknesses being matched at the box base and top by areas of the same shape and position which are of lesser number of thicknesses, the creased flaps of the first set joining panels which form two opposed sides of the box and the creased flaps of the second set joining the panels which form the other two opposed sides of the box.

7. A box according to claim 4, 5 or 6, and which comprises a first sleeve including four wall panels and said first set of flaps, and a second sleeve including four wall panels and said second set of flaps, the first and second sleeves being telescoped together with the wall panels of one sleeve lying adjacent the wall panels of the other sleeve.

* * * * *